US005735294A

United States Patent [19]

McDonough et al.

[11] Patent Number: 5,735,294

[45] Date of Patent: *Apr. 7, 1998

[54] LIGHTER WITH GUARD

[75] Inventors: James M. McDonough, Guilford, Conn.; Gerald J. Doiron, Marco Island, Fla.; Paul H. Adams, Monroe, Conn.; Chris A. Barone, Trumbull, Conn.; Floyd B. Fairbanks, Naugatuck, Conn.

[73] Assignee: Bic Corporation, Milford, Conn.

[ * ] Notice: The term of this patent shall not extend beyond the expiration date of Pat. No. 5,483,978.

[21] Appl. No.: 586,719

[22] PCT Filed: Jul. 26, 1994

[86] PCT No.: PCT/US94/08447

§ 371 Date: Jan. 29, 1996

§ 102(e) Date: Jan. 29, 1996

[87] PCT Pub. No.: WO95/04247

PCT Pub. Date: Feb. 9, 1995

Related U.S. Application Data

[63] Continuation-in-part of Ser. No. 261,527, Jun. 17, 1994, Pat. No. 5,520,197, which is a continuation-in-part of Ser. No. 97,685, Jul. 28, 1993, Pat. No. 5,483,978.

[51] Int. Cl.[6] ..... F23D 11/36

[52] U.S. Cl. ..... 131/329; 431/267; 431/273; 431/274; 431/153

[58] Field of Search ..... 131/329; 431/267, 431/273, 274, 153

[56] References Cited

U.S. PATENT DOCUMENTS

| | | | |
|---|---|---|---|
| D. 205,465 | 8/1966 | Breman | D48/27 |
| D. 211,822 | 7/1968 | Banninger | D48/27 |
| D. 212,382 | 10/1968 | Van Poppel | D48/27 |
| D. 212,828 | 11/1968 | Van Poppel | D48/27 |
| D. 216,328 | 12/1969 | Guier | D48/27 |
| D. 217,017 | 3/1970 | Beijeering | D48/27 |
| D. 229,712 | 12/1973 | Vogel | D48/27 R |
| D. 240,303 | 6/1976 | Neyret | D27/42 |
| D. 241,556 | 9/1976 | Matsuo | D27/42 |
| D. 247,051 | 1/1978 | Tricot | D27/42 |
| D. 272,564 | 2/1984 | Racek | D27/42 |
| 2,168,732 | 8/1939 | Dubsky | 67/7.1 |
| 2,498,377 | 2/1950 | Nissen | 431/137 X |
| 3,174,309 | 3/1965 | Kobayashi | 67/7.1 |
| 3,439,994 | 4/1969 | Cassan | 431/254 |
| 3,506,387 | 4/1970 | Dupont | 431/275 |
| 3,752,637 | 8/1973 | Norman | 431/274 |
| 3,756,766 | 9/1973 | Green | 431/254 |
| 3,884,616 | 5/1975 | Neyret | 431/276 X |
| 3,884,618 | 5/1975 | Neyret | 431/276 X |
| 3,895,905 | 7/1975 | Nissen | 431/254 |
| 3,938,943 | 2/1976 | Malamoud | 431/144 X |
| 3,994,666 | 11/1976 | Spinosa | 432/144 |
| 4,028,043 | 6/1977 | Neyret | 431/144 |
| 4,049,370 | 9/1977 | Neyret | 431/144 |
| 4,190,412 | 2/1980 | Nitta | 431/151 |
| 4,416,612 | 11/1983 | Tabeta | 431/131 |
| 4,846,667 | 7/1989 | Lin | 431/151 |
| 5,017,128 | 5/1991 | Hunter | 431/277 |
| 5,085,578 | 2/1992 | Hunter | 431/277 |
| 5,483,978 | 1/1996 | Doiron | 131/329 |

FOREIGN PATENT DOCUMENTS

| | | | |
|---|---|---|---|
| 637828 | 5/1928 | France | 431/129 |
| 936273 | 7/1948 | France | 431/139 |
| 0677021 | 3/1991 | Switzerland | 431/129 |

*Primary Examiner*—Vincent Millin
*Assistant Examiner*—Charles W. Anderson
*Attorney, Agent, or Firm*—Pennie & Edmonds LLP

[57] ABSTRACT

The lighter of the present invention provides a resiliently deformable guard that covers a portion of the striking wheel assembly. To operate the lighter, a user exerts sufficient pressure to depress the guard before rotating the striking wheel assembly. The present invention provides retention mechanisms to make removal of the guard more difficult. Further, the lighter of the present invention provides brake members to prevent the rotation of the striking wheel assembly when the user attempts to release fuel prior to rotating the striking wheel assembly.

35 Claims, 10 Drawing Sheets

LIGHTER WITH GUARD

CROSS REFERENCE TO RELATED APPLICATIONS

This application is a continuation-in-part of Ser. No. 08/261,527 now U.S. Pat. No. 5,520,197 filed Jun. 17, 1994, which is a continuation-in-part of application Ser. No. 08/097,685, now U.S. Pat. No. 5,483,978 filed Jul. 28, 1993.

FIELD OF THE INVENTION

The invention relates to a cigarette lighter having a guard device incorporated into the lighter. Such devices help to resist undesired usage of the lighter by young children.

BACKGROUND OF THE INVENTION

Recently, attention has been directed toward preventing ready actuation of lighters by persons normally not able to appreciate the potential danger of the flame. Such danger includes the potential to burn the individual directly or to burn surrounding areas or items. Individuals normally contemplated in these efforts are young children in the age category of five years or younger.

A conventional cigarette lighter includes a body containing a fuel reservoir filled with a liquified and pressurized hydrocarbon fuel, a valve actuator lever, a striker wheel, a flint in frictional contact with the striker wheel, a fuel flow control valve in fluid communication with the fuel reservoir. After the striker wheel is rotated against the flint by digital manipulation to produce sparks, the valve actuator lever is depressed allowing gaseous hydrocarbon fuel to flow out of the reservoir through the flow control valve. The sparks then ignite the released fuel producing a flame. Such lighters are known in the art, and are commercially available.

It is relatively easy for the intended adult users to operate the conventional prior art lighters. It is desirable to increase the difficulty of use to limit the ability of young children under five years of age to operate such lighters. For this reason there are many proposed "child-resistant" lighters offered in the patent literature and on the market. Examples of such patents include U.S. Pat. No. 5,125,829; U.S. Pat. No. 5,002,482; U.S. Pat. No. 5,165,886; U.S. Pat. No. 5,090,893; and PCT Application No. WO 93/17282. Each of the disclosed devices has in common the fact that the child-resistant feature somehow acts to block movement of the gas fuel release mechanism to prevent operation of the lighter.

Although many of the currently available designs provide a degree of "child resistancy," there is a continuing search in the art for designs which are easy for the intended adult to operate while retaining their "child resistancy."

SUMMARY OF THE INVENTION

Accordingly, it is an object of the invention to provide a lighter which is easily operated by an adult, but resistant to operation by young children.

It is a further object of the invention to provide such lighter that can be relatively easy to manufacture with a minimal design modification.

It is another object of the invention to provide a child-resistant feature for such a lighter that is not easily defeated or removed by the normal user.

These and other objects are achieved according to the present invention by a lighter that requires at least a threshold amount of digital pressure, i.e., pressure exerted by a finger or thumb, be applied on a protective guard before the striking wheel assembly can be rotated against the flint to create sparks. Further, the present invention provides a combination of retention elements to make the removal of the protective guard more difficult. Additionally, the present invention includes brake means to prevent the striking wheel assembly from rotating after the valve actuator is depressed.

These features are provided by a lighter comprising a body having a fuel reservoir and a cylindrical cavity, and a striking wheel assembly rotatably mounted on the body at a top end, wherein the striking wheel assembly comprises a rotary sparker and at least one turning wheel mounted co-axially with the rotary sparker. The lighter further comprises a flint disposed within the cylindrical cavity and biased into frictional contact with the rotary sparker, wherein rotation of the rotary sparker against the flint creates sparks, and a valve for releasing fuel from the fuel reservoir to outside the body of the lighter, wherein the valve has an open position and a closed position. The lighter further comprises a valve actuator pivotally attached to the body, wherein the actuator is capable of moving the valve between the open position and closed position, and a shield.

The lighter of the present invention further comprises a cover comprising an arcuate guard disposed above the rotary sparker and elevated above the at least one turning wheel, wherein the cover further comprises a head portion which couples the guard to the shield, and wherein the arcuate guard is depressed to a level where the at least one turning wheel can be manipulated, and a stop member disposed on the lighter body at a predetermined distance from the guard to limit deflection of the guard. Alternatively, the guard and the head portion can be made integral to the shield.

Further, instead of being part of the cover, which is in turn coupled to the shield, the arcuate guard can be manufactured separately and directly coupled to the shield. Additionally, the guard may also have a spark blocking member disposed between the fuel valve and the striking wheel assembly to prevent the spark from reaching the fuel valve, and a spark orifice to allow the spark to pass therethrough after the guard is depressed.

The valve actuator of the lighter comprises at least one brake member, preferably having a plurality of teeth on one side, wherein after the valve actuator is depressed and the valve is moved to the open position, the teeth of the at least one brake member arrest the rotation of the striking wheel assembly.

Also, the shield of the lighter comprises a plurality of retention elements for resisting the removal of the shield from the body of the lighter, wherein the retention elements preferably comprise (i) a pair of tongues orientated upwardly and located on the shield and a pair of corresponding recesses located on the top end of the body of the lighter, (ii) a pair of flanges on the shield, wherein the flanges wraparound a first edge of said top end, and (iii) a pair of detents on the shield cooperating with a pair of holes defined by the top end. A hook also may be provided on the end of the guard to catch under the valve actuator and further increase the difficulty of removing the shield.

Thus, a lighter having the above described guard feature should provide a young child with sufficient deterrent features as to prevent the child from readily producing a flame, or to deter the child from readily producing a flame at least for a time sufficient to permit the normally expected adult intervention. Additionally, the retention elements on the shield should provide a higher level of resistance against the undesirable removal of the shield.

DETAILED DESCRIPTION OF THE PREFERRED EMBODIMENTS

Figure 1:
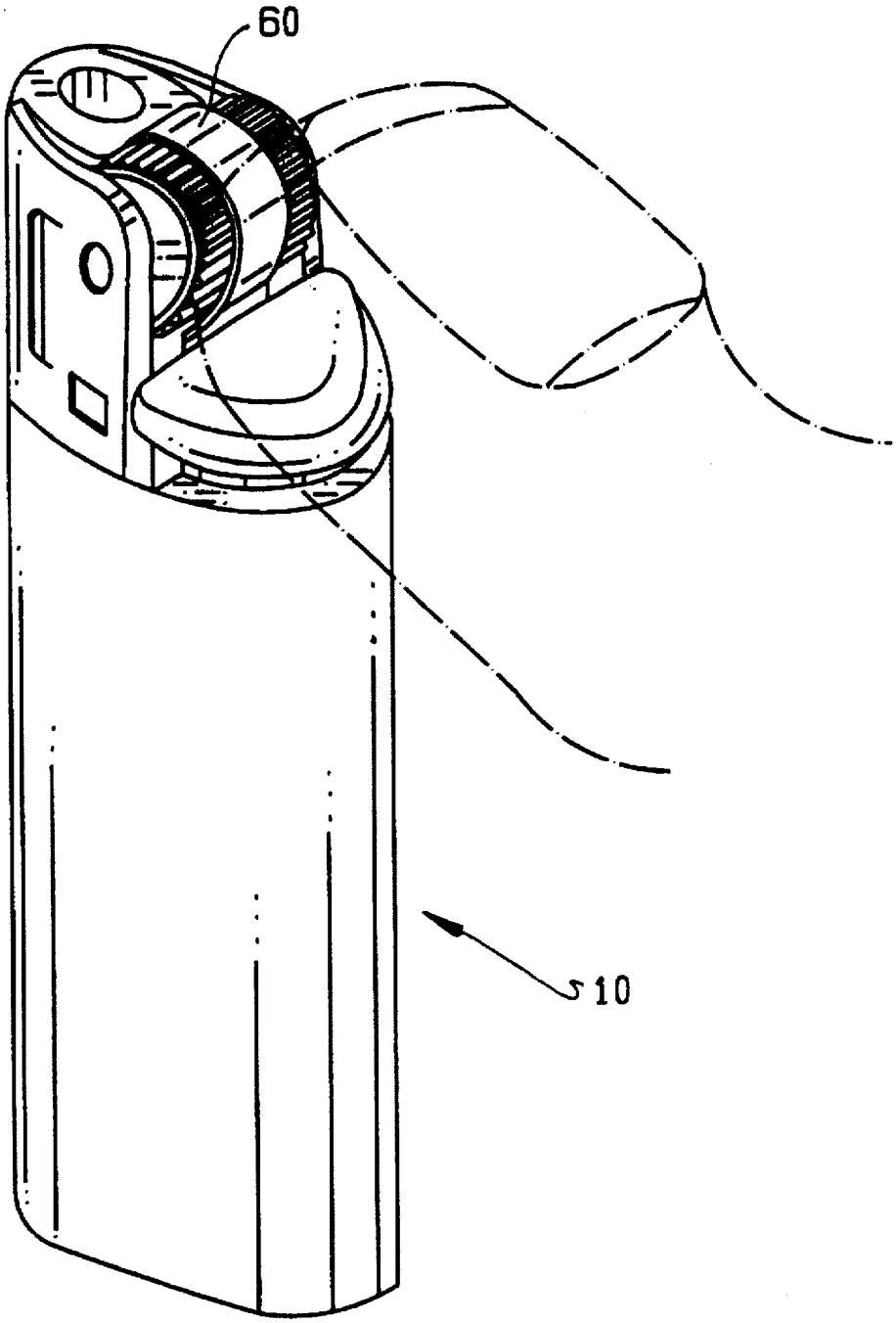
FIG. 1 is a perspective view of a lighter of the present invention.

Referring to the drawings, wherein like reference numbers are used to designate like parts and as shown in FIG. 1, lighter 10 according to the present invention is shown having a protective guard 60 disposed above a portion of the striking wheel assembly.

Figure 2:
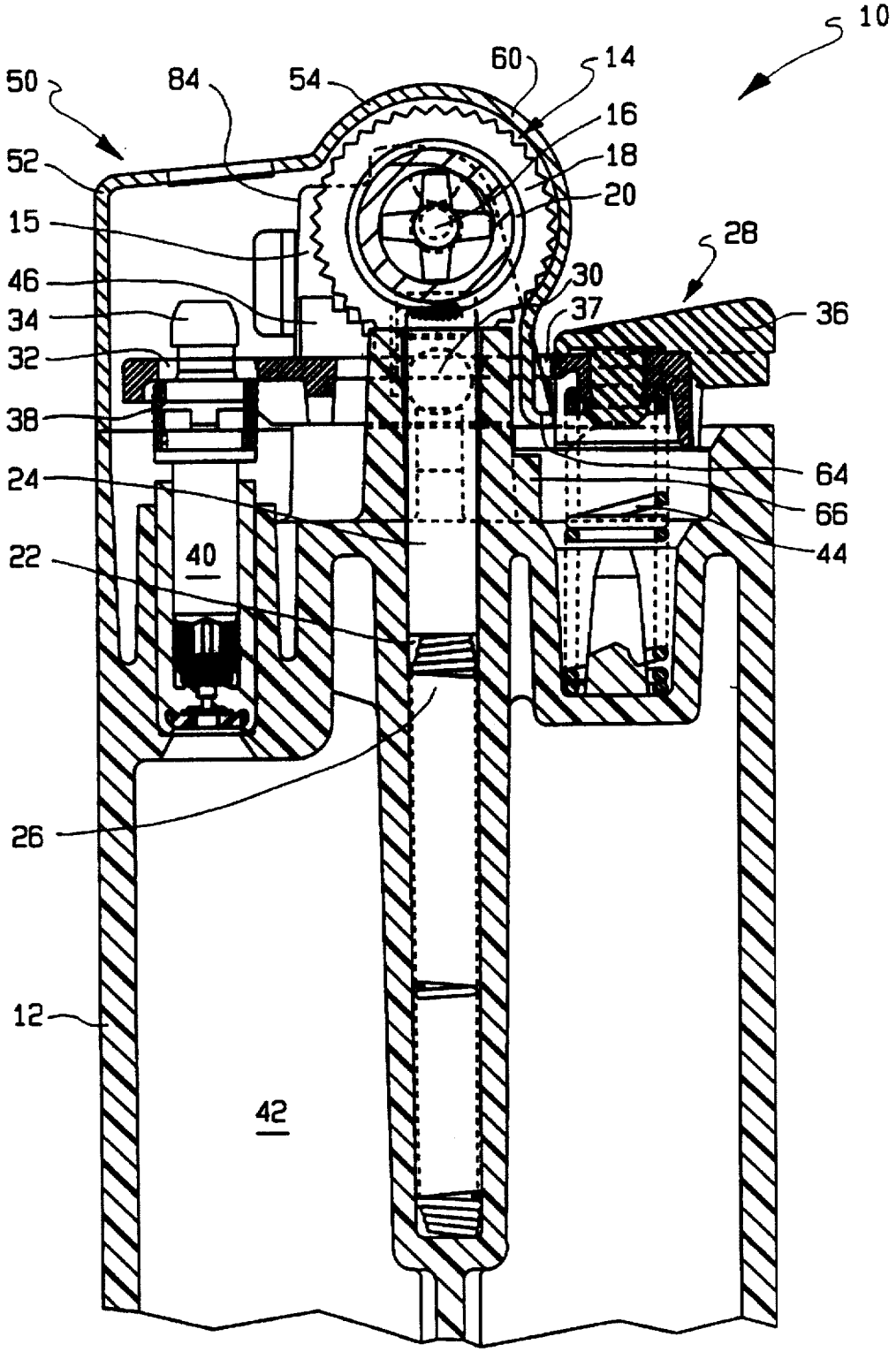
FIG. 2 is cross-sectional side view of the lighter of the present invention.
Figure 3:
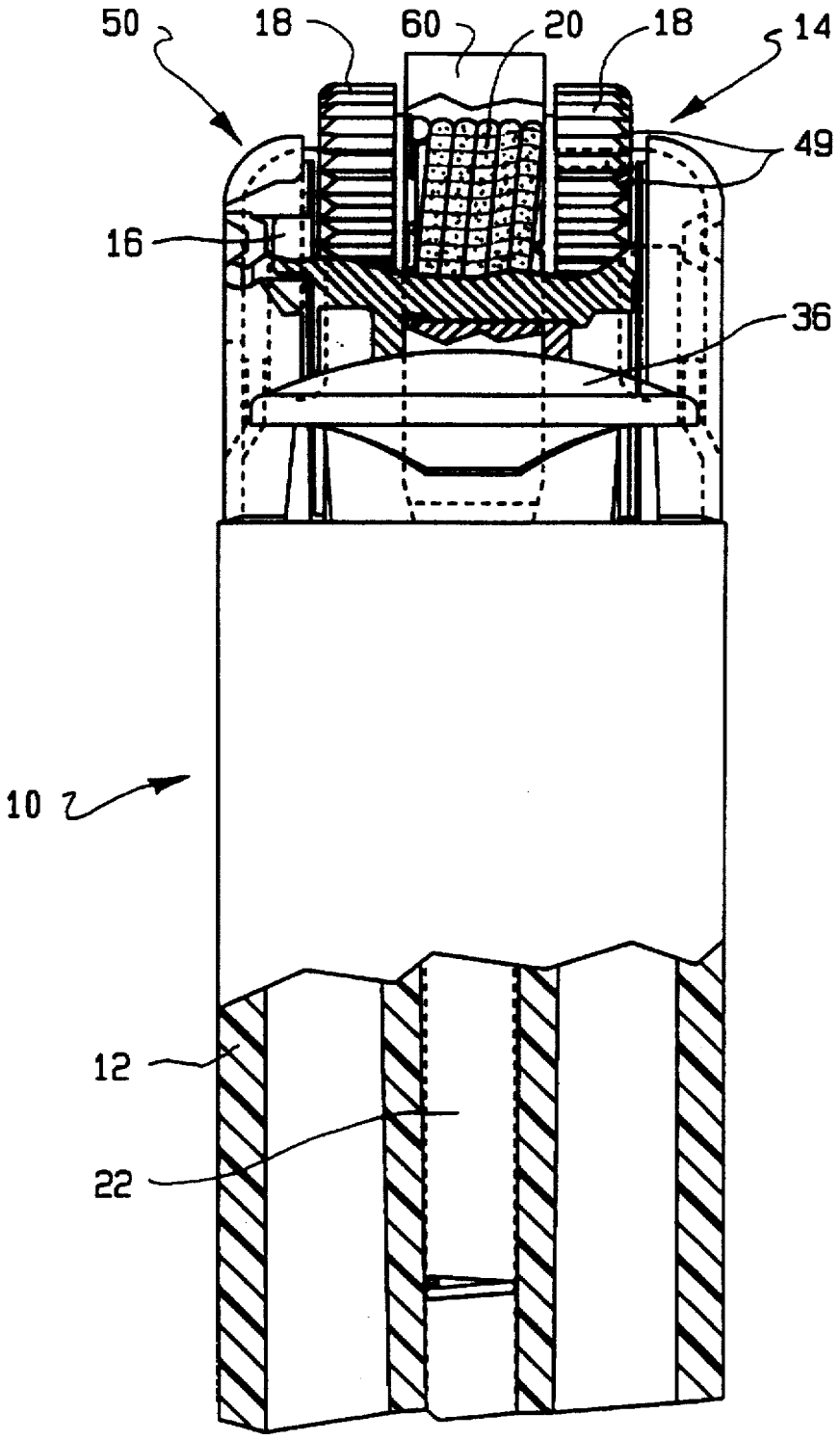
FIG. 3 is a partial cross-sectional rear view of the lighter of the present invention.

More particularly shown in FIGS. 2 and 3, lighter 10 has body 12 with striking wheel assembly 14 rotatably disposed between spark-wheel supports 15 (shown partially in phantom in FIG. 2) via axle 16. Striking wheel assembly 14 is located at the top end of body 12 and comprises turning wheels 18 disposed on each side of rotary sparker 20. The two turning wheels 18 and sparker 20 are connected to one another, and are mounted co-axially on axle 16. Body 12 defines a cylindrical cavity 22 positioned longitudinally and centrally within body 12. Flint 24 is disposed within cavity 22, and is urged into frictional contact with rotary sparker 20 by spring 26.

Figure 5:
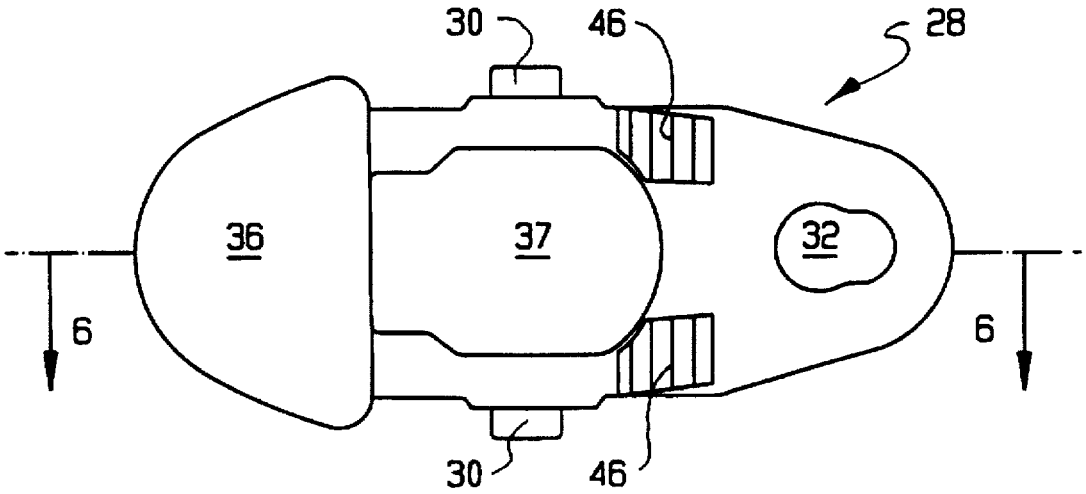
FIG. 5 is a top plan view of a valve actuator of the present invention.
Figure 6:
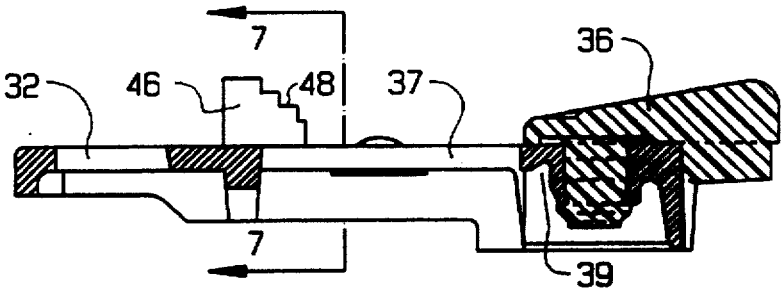
FIG. 6 is a cross-sectional view of a valve actuator of the present invention along line 6—6 in FIG. 5.
Figure 7:
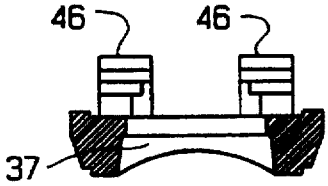
FIG. 7 is a cross-sectional view of a valve actuator of the present invention along line 7—7 in FIG. 6.

Lighter 10 further comprises a valve actuator 28, which is pivotally mounted on body 12 through tabs 30, which are located below axle 16. As shown in FIGS. 5–7, valve actuator 28 defines slot 32 at one end. At the other end of the valve actuator 28 is thumb pad 36. In its middle region, valve actuator 28 defines an opening 37, which allows flint 24 to extend from lighter body 12 through valve actuator 28 to reach rotary sparker 20.

Valve 40 controls the release of fuel from reservoir 42. In a preferred embodiment, valve 40 is a normally open valve, forced open by the pressure of fuel within reservoir 42. In this embodiment, as shown in FIG. 2, valve actuator 28 acts on valve 40 to maintain it in a closed position. Compression spring 44 pushes up on a first end of valve actuator 28, forcing the second, opposite end to act downwardly on valve 40 where it extends through slot 32. This pressure maintains the valve in a closed position until thumb pad 36 is sufficiently depressed allowing the nozzle 34 of valve 40 to be lifted and thereby releasing the fuel. Second compression spring 38 acts between the valve actuator and valve stem to prevent release of fuel before the thumb pad is depressed to a sufficiently actuated position. It is contemplated that other suitable valve configurations may be selected by persons of ordinary skill in the art. For example, a normally closed valve, which is forced open by the lifting of the second end of the valve actuator due to depression of the thumb pad may be utilized.

Valve actuator 28 further comprises two brake members 46 as shown in FIGS. 5–7. Each brake member 46 preferably has a generally angled surface with a plurality of teeth 48 on one side of the brake member. Teeth 48 are oriented toward turning wheels 18. The two brake members 46 work in conjunction with the two turning wheels 18 to stop the rotation of the striking wheel assembly. Other configurations, such as a curved surface opposing the turning wheels with a material to grip or to otherwise engage the turning wheels or other parts of the striking wheel assembly, or a squared off member with an edge that catches on a turning wheel may be used. A person of ordinary skill in the art may select a suitable configuration for stopping the rotation of the striking wheel assembly based on the teachings of the present invention. After the valve actuator 28 is depressed and moved into its operative position, the brake members move toward the striking wheel assembly and engage the turning wheels in such a way that teeth 48 mesh with the teeth 49 on the turning wheels 18 and arrest any further rotation of striking wheel assembly 14.

Figure 8:
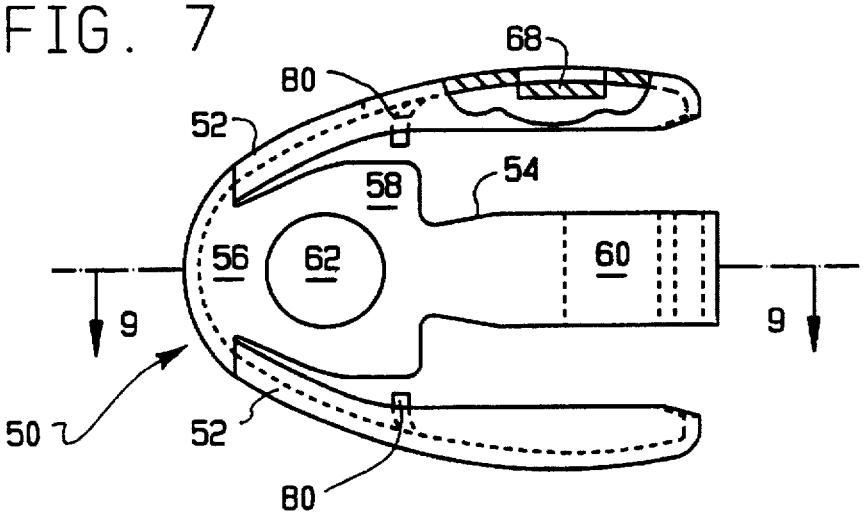
FIG. 8 is a top plan view of a shield and guard of the present invention.
Figure 9:
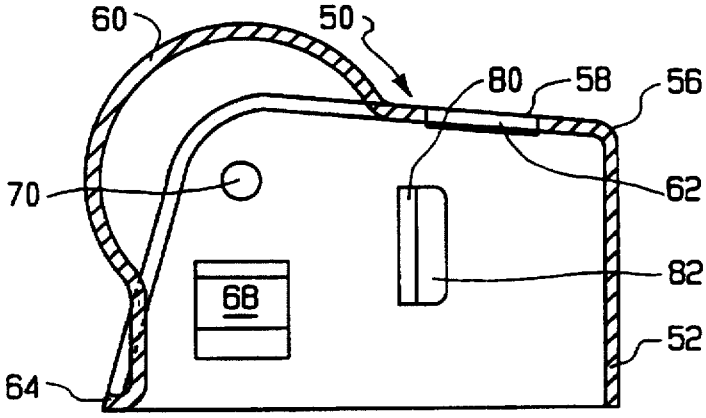
FIG. 9 is a cross-sectional side view of a shield and guard of the present invention along line 9—9 in FIG. 8.
Figure 19:
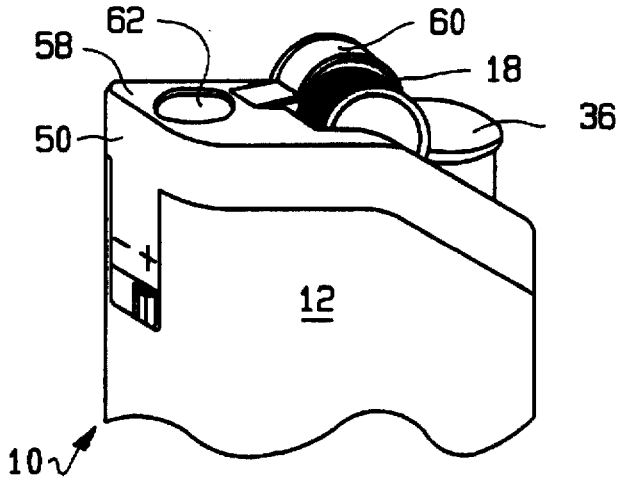
FIG. 19 is a partial side view of another guard of the lighter of the present invention.
Figure 20:
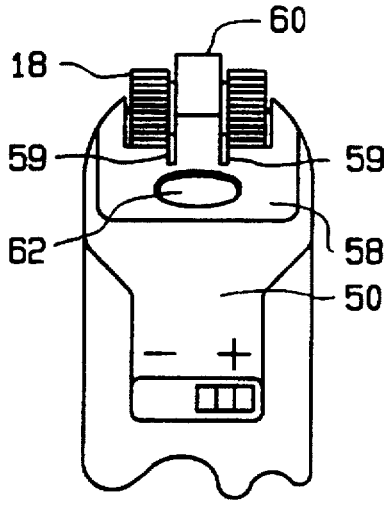
FIG. 20 is a partial front view of the lighter shown in FIG. 19.

Lighter 10 also has windbreaking shield 50 mounted on top of body 12 enclosing the spark-wheel supports 15 and around valve 40, as shown in FIG. 2. Shield 50 assists in the generation and maintenance of the flame. Referring to FIGS. 8–9, shield 50 comprises body portion 52 and cover portion 54, which includes head portion 58 and arcuate guard 60. Cover 54 is fixedly attached to body portion 52 at neck 56; preferably it is formed integrally therewith as shown. Head portion 58 defines flame orifice 62, which is disposed directly above valve 40. Preferably integrally connected to head portion 58 is guard 60. Alternatively, instead of being made integral with head portion 58, arcuate guard 60 may be separately formed and then coupled or otherwise mechanically linked to head portion 58, as shown in FIGS. 19 and 20, where a slightly different lighter 10 is shown. In this embodiment, head portion 58 can be an integral part of shield 50. To increase the resiliency of guard 60, slits 59 are provided at the location where guard 60 is coupled to head portion 58 as shown in FIG. 20.

Figure 12:
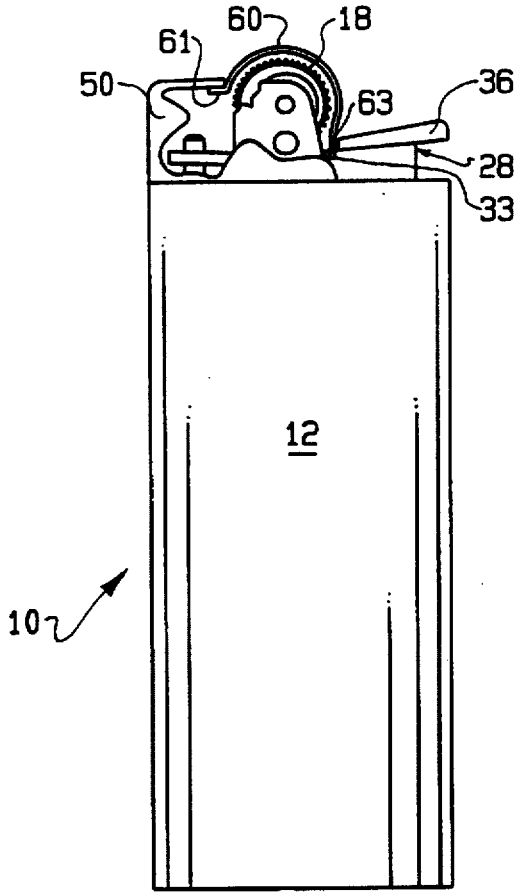
FIG. 12 is a side view of another embodiment of the present invention.
Figure 13:
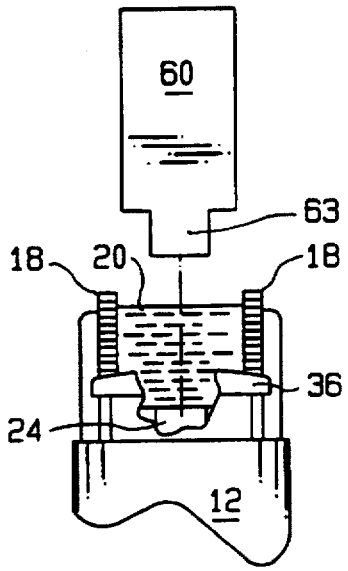
FIG. 13 is an exploded partial rear view of the lighter shown in FIG. 12.
Figure 14:
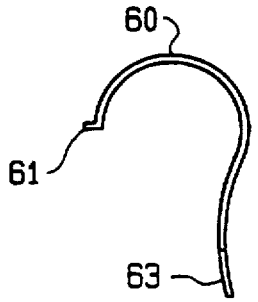
FIG. 14 is a side view of another arcuate guard of the lighter shown in FIG. 13.
Figure 15:
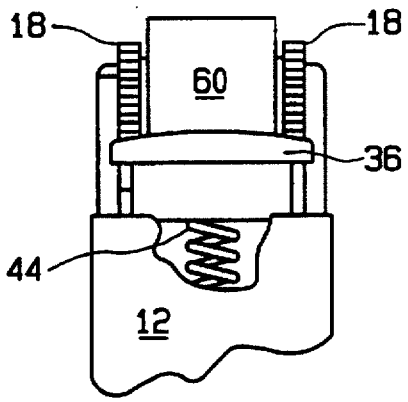
FIG. 15 is a partial rear view of the lighter shown in FIG. 12 with a partial cutaway.
Figure 23:
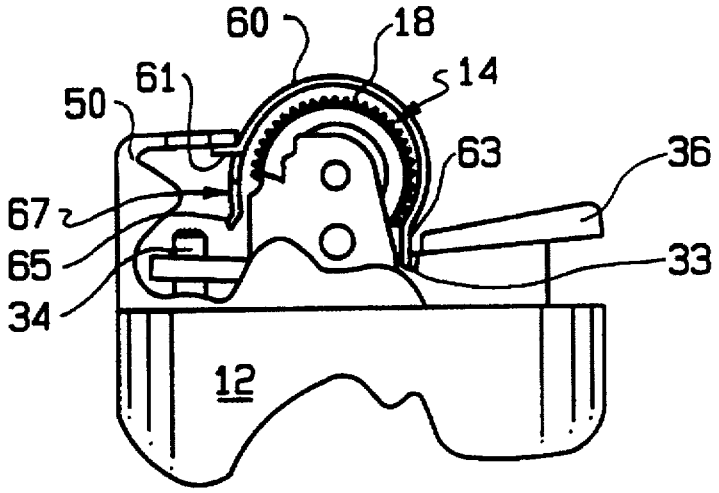
FIG. 23 is a partial side view of a lighter of the present invention having the guard shown in FIGS. 21 and 22.

Guard 60 can also be separately formed and fitted over or under the shield and over the rotary sparker. An example of such an arcuate guard is shown in FIGS. 13 and 14. As shown, guard 60 comprises at least one retaining member 61 and an end 63 with a reduced width. End 63 is inserted into a cavity or hole 33 provided in the actuator 28, as shown in FIGS. 12 and 23. Retaining member 61 on the opposite end of the guard is fitted under shield 50 such that guard 60 is disposed over the rotary sparker, as shown in FIGS. 12 and 15.

Alternatively, end 63 may be inserted through opening 37 of valve actuator 28 until end 63 comes into contact with a portion of lighter body 12, such as stop member 66 which is shown in FIG. 2. As such, end 63 may be inserted into a hole in the lighter body rather than a hole in the valve actuator.

Figure 21:
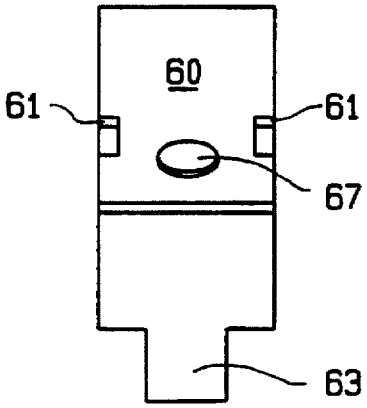
FIG. 21 is a front view of another arcuate guard according to the present invention.
Figure 22:
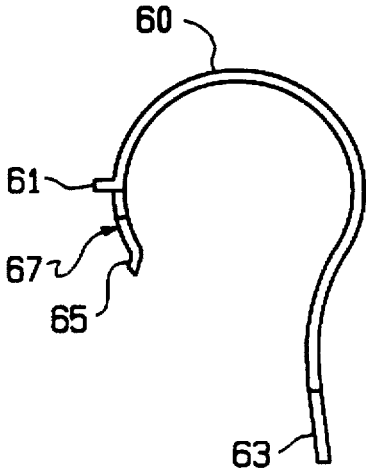
FIG. 22 is a side view of the guard shown in FIG. 21.
Figure 24:
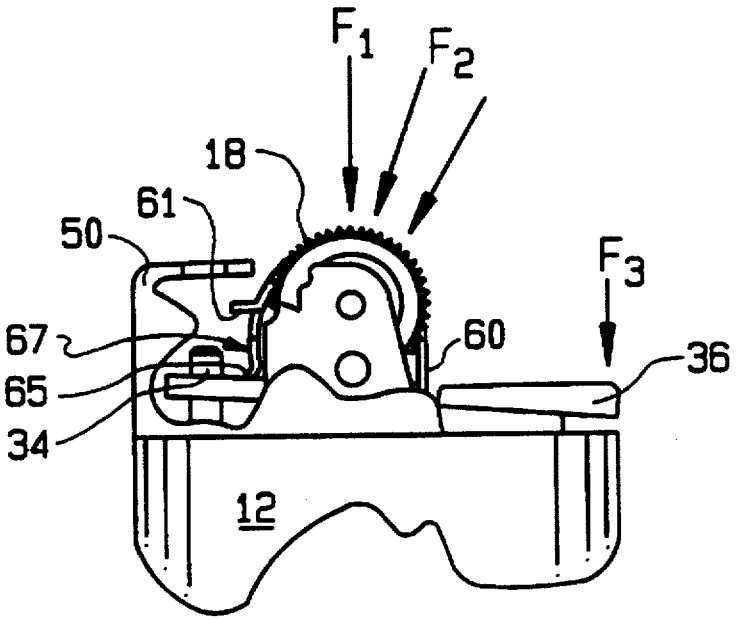
FIG. 24 is a partial side view of the lighter shown in FIG. 23 with the guard depressed.

Additionally, in this embodiment guard 60 may also have a spark blocking member 65, located below the retaining member 61 as shown in FIG. 22. Referring to FIG. 23, spark blocking member 65 is disposed between the striking wheel assembly 14 and fuel valve 40, such that unless the guard is depressed, spark blocking member 65 prevents any spark that might be produced from igniting the fuel released from fuel valve 40. Guard 60 also defines a spark orifice 67 disposed between spark blocking member 65 and retaining member 61 as shown in FIGS. 21 and 22, such that after the guard is depressed the spark orifice 67 is disposed between the striking wheel assembly and the fuel valve, as shown in FIG. 24, and spark blocking member 65 is moved downward.

Figure 4:
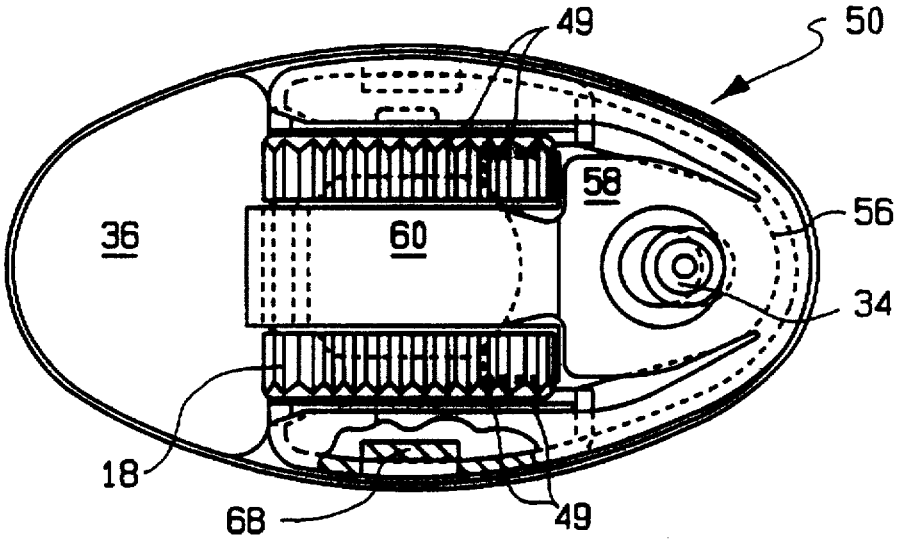
FIG. 4 is a top view of the lighter of the present invention.

As shown in FIGS. 2, 3, and 4, guard 60 is shaped and dimensioned to fit over the rotary sparker 20, and to be positioned radially beyond and above the turning wheels 18. However, the width of guard 60 is such that it extends between but preferably not over wheels 18. Guard 60 is preferably elevated above the surfaces of the turning wheels 18, such that guard 60 should be depressed before turning wheels 18 can be rotated. Further, guard 60 preferably terminates at the opposite end with a curved hook or lip 64 (see FIG. 9).

After the lighter 10 is assembled, curved lip 64 passes through opening 37 of valve actuator 28 and is positioned at a predetermined distance above a stop member 66 (see FIG. 2). Stop member 66 may be formed as a ledge on the exterior wall of cylindrical cavity 22. As stated above, to produce a flame, the user depresses guard 60. Responding to the exerted pressure on guard 60, cover 54 is deformed typically at neck 56, thereby producing an elastic deflection about neck 56 (as shown in FIG. 2). Guard 60 displaces across some or all of the predetermined distance between curved lip 64 and stop member 66. Stop member 66 prevents the over-deflection of cover 54 to protect the elasticity of neck 56. In addition to the elastic deflection about neck 56, arcuate guard 60 may also be elastically deformed in response to the pressure applied on guard 60. After the applied pressure is relieved, neck 56 and guard 60 will resume their former shapes and positions.

Figure 16:
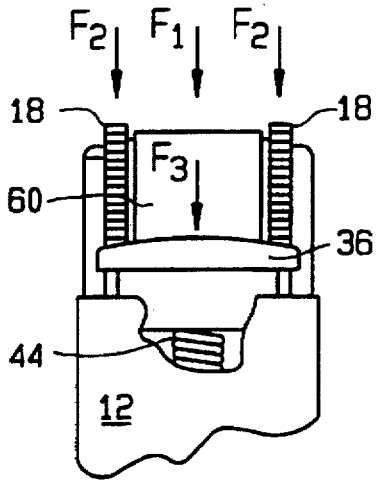
FIG. 16 is a partial rear view of the lighter shown in FIG. 15 with the arcuate guard depressed.
Figure 17:
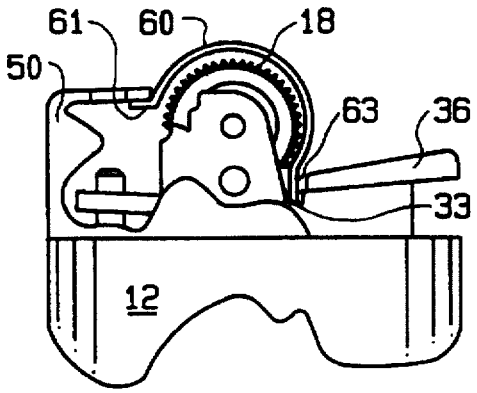
FIG. 17 is a partial side view of the lighter shown in FIG. 15.
Figure 18:
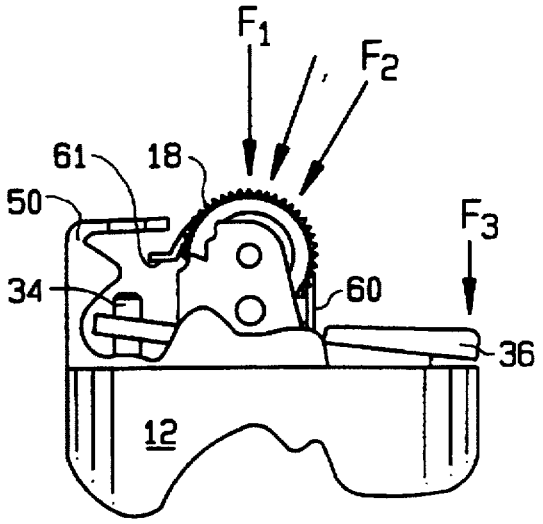
FIG. 18 is a partial side view of the lighter shown in FIG. 16.

To operate the lighter of the present invention the user asserts a sufficient pressure greater than a predetermined pressure necessary to deform guard 60 and/or to deform neck 56, such that guard 60 at least partially moves to a position closer to the turning wheels 18, or to a position between the turning wheels 18, to permit the user's finger to engage the wheels for rotation, as shown generally in FIGS. 15, 16, 17 and 18. As shown in FIGS. 15 and 17, guard 60 is in its undepressed state. Referring to FIGS. 16 and 18, F1 is first applied to guard 60 to partially move it to a position where turning wheels 18 can be manipulated. F2 is then applied to rotate the turning wheels 18 to produce the spark. F3 is then applied to depress thumb pad 36 of valve actuator 28 to actuate valve 40 to release the fuel to be ignited by the produced spark.

Alternatively, it is not necessary to deform guard 60 or to bend neck 56. If guard 60 is positioned such that the fleshy, pulp portion of the adult user's finger is sufficient to extend over and around guard portion 60, the adult's finger can contact turning wheels 18 for rotation without such deformation. Preferably, rotation of the turning wheels would be a result of a combination of both types of action, i.e., the deformation of the guard and neck and the extension of the adult finger partially around the guard. It has been found that a shield and guard made of 1050 C.R. steel hardened by heat treatment to a hardness equal to a Rockwell C-40 hardness, with a thickness of about 0.020 inch (0.5 mm), provide satisfactory results. As will be appreciated by persons of ordinary skill in the art, other materials, hardnesses and thicknesses may be used. Based on the teachings of the present invention as set forth herein, a person of ordinary skill in the art could adapt the present invention as desired.

Rotation of the turning wheels 18 causes a spark to be produced in a conventional manner. After the spark is produced by rotation of the turning wheels 18, the user's finger depresses the thumb pad 36 on the valve actuator 28 to actuate a release of fuel from the valve 40. This action occurs after the creation of the spark, as shown in FIG. 18. When rotated with sufficient force by an adult user, the spark created is large enough to ignite the fuel even though it is normally not released until a period of time after the creation of the spark.

The lighter as described above, is child-resistant because generally children under five years of age do not have sufficient coordination, digit size or strength to operate the present invention as described. In order to resist two-hand operation of the lighter, brake members 46 as previously described are provided. The brake members 46 engage turning wheels 18 to prevent rotation thereof once the valve actuator is depressed. Thus, if a user attempts to actuate the lighter by first depressing the valve actuator 28 with one hand and then rotating the turning wheels 18 with another, brake members 46 engage turning wheels 18 to prevent rotation thereof and thus prevent creation of a spark. Preferably, tension spring 38 prevents the release of fuel from valve 40 until thumb pad 36 is depressed to a position wherein the brake members engage the turning wheels.

Because guard 60 forms part of the resistancy of the lighter, it is advantageous to resist or make more difficult the removal of guard 60. The present invention therefore provides a retention system designed to make more difficult the removal of shield 50 as compared to the shields of prior art lighters. The retention system works in conjunction with spark-wheel supports 15 located at the top end of lighter body 12 and with the actuator 28 to secure shield 50 in place. In a preferred embodiment, the retention system according to the present invention comprises a number of retention means formed in shield 50, including hook 64 at the end of guard 60, tongues 68, detents 70 and flanges 80. The various means may be employed in different combinations or all together.

The formation of hook 64 at the end of guard 60 is clearly shown in FIG. 9. Referring also to FIG. 8, other retention means are shown. Tongues 68 extend inwardly on the inside of body portion 52 of shield 50. In a preferred embodiment, the tongues are stamped from the material of the shield. Detents 70 are also formed in the side of body 52, again preferably stamped therein and extending inwardly. Flanges 80 are formed by stamping and folding over a portion of body 52 which also creates air vents 82. Flanges 80 thus comprise a portion of the body 52 folded inward to create vertically and inwardly extending flanges.

Figure 10:
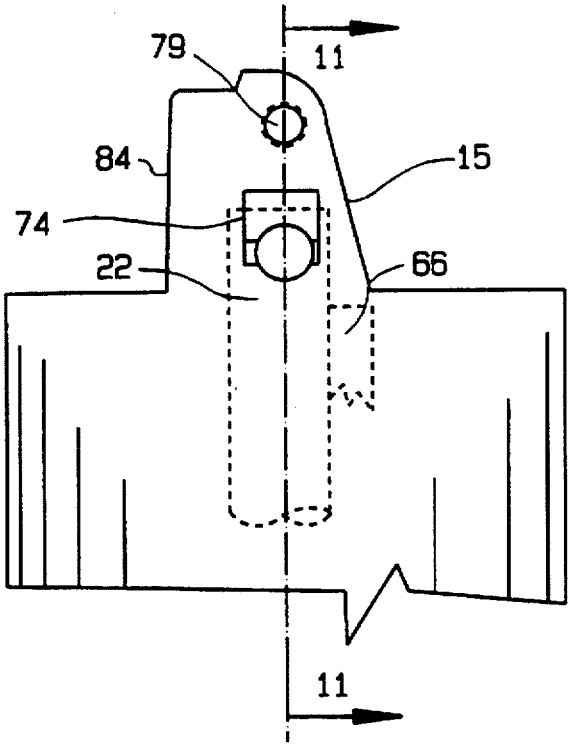
FIG. 10 is a side view of the body of the lighter of the present invention.
Figure 11:
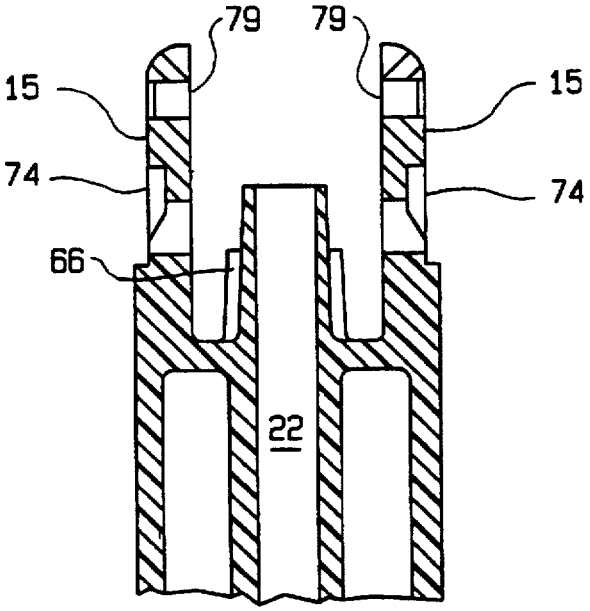
FIG. 11 is a cross-sectional view of the body of the lighter of the present invention along line 11—11 in FIG. 10.

When shield 50 is assembled onto the lighter body 12, the retention means as described above secure the shield in place and increase the difficulty of its removal. Tongues 68 are received in corresponding recesses 74 on spark-wheel supports 15 as shown in FIGS. 10 and 11. Detents 70 are received in the outside ends of holes 79 as shown in FIGS. 10 and 11, which also carry spark-wheel axle 16. Hook 64 on the end of guard 60 extends through opening 37 in valve actuator 28 and engages under recess 39 (as shown in FIG. 6) of the valve actuator 28. Flanges 80 lock against the vertical surface 84 of each spark-wheel support 15 again as shown in FIGS. 2, 10 and 11. This combination of retention means and the increased stiffness of the shield, produced for example by heat treating as stated above, increases the difficulty of moving the shield front to back or up and down and thus increases the difficulty of removing guard 60. Such retention means also may be employed with safety elements other than guard 60 which may be mounted on the windbreaking shield of the lighter.

While various descriptions of the present invention were described above, it is understood that the various features of the present invention can be used singly or in any combination thereof. Therefore, this invention is not to be limited to only the specifically preferred embodiments depicted therein.

What is claimed is:

1. A lighter comprising:

a lighter body containing a fuel reservoir with a valve for releasing fuel therefrom;

spark producing element rotatable by a user to produce sparks directed toward said valve, said element mounted on the body with at least a portion thereof exposed of manipulation and rotation by the user;

a valve actuator depressible to actuate said valve and release said fuel; and a guard member mounted on the lighter and extending around at least said exposed portion of said spark producing element, wherein said shield member is disposed radially outward from said spark producing element and is depressible to a position permitting manipulation of said spark producing element.

2. The lighter as set forth in claim 1 wherein the guard member comprises a first end, wherein the first end is inserted into a hole defined in the valve actuator and secured to the lighter thereby.

3. The lighter as set forth in claim 1 wherein the guard member comprises a first end, wherein the first end is inserted through an opening through the valve actuator and received in a hole in the lighter body.

4. The lighter as set forth in claim 1 wherein the lighter further comprises a windbreaking shield disposed on the lighter body and wherein the guard is fixedly coupled at one end to said shield.

5. The lighter as set forth in claim 4 wherein the guard member is formed integrally with said shield.

6. The lighter as set forth in claim 4 wherein at least one slit is provided at a location where the guard is coupled to the shield.

7. The lighter as set forth in claim 1 wherein the guard member further comprises a spark blocking member normally interposed between the valve and the spark producing element to prevent sparks from reaching the valve unless the shield is depressed.

8. The lighter as set forth in claim 7 wherein the guard member further defines a flash aperture positioned on said member such that when the shield is depressed, the flash aperture is moved to a position adjacent to the valve allowing sparks to pass therethrough to reach the valve.

9. The lighter as set forth in claim 8 wherein a pressure necessary to depress the guard is proportional to the thickness of the guard.

10. The lighter as set forth in claim 9 wherein the pressure necessary to depress the guard is further proportional in part to the stiffness of the guard.

11. The lighter as set forth in claim 10 wherein the guard is depressible by digital pressure.

12. The lighter as set forth in claim 11 wherein the digital pressure required to depress the guard and to operate the spark producing element is sufficient to increase the level of difficulty, compared to prior art lighters, of the operation of the lighter by a child.

13. A lighter comprising:

a lighter body containing a fuel reservoir with a valve for releasing fuel therefrom, wherein the valve comprises a nozzle arranged along the longitudinal axis and communicating with the fuel reservoir to selectively permit release of fuel from the reservoir;

spark producing element rotatable by a user to produce sparks directed towards released fuel, said element mounted on the body with at least a portion thereof exposed for manipulation and rotation by the user;

guard member mounted on the lighter and extending around at least said exposed portion of said spark producing element, wherein said guard member is disposed radially outward from said spark producing element by a predetermined distance such that manipulation of said element is prevented until application of a predetermined force sufficient to elastically deform said guard member to a position permitting manipulation of said spark producing element;

valve actuator depressible to actuate said valve and release said fuel; and brake member cooperating with said valve actuator to prevent rotation of said spark producing element after depression of said valve actuator.

14. The lighter according to claim 13, wherein:

said valve actuator comprises a pivoting lever pivotable about a point disposed under said spark producing element with a first end depressible by a user and a second end raisable in response thereto to actuate said valve; and said brake member comprises at least one upstanding member disposed on said pivotable lever between said second end and the pivot point such that depression of the first end causes the brake member to engage the spark producing element.

15. The lighter according to claim 13, wherein said guard member is integrally formed with a shield surrounding and protecting the fuel release valve.

16. The lighter according to claim 15, further comprising retention means for increasing the difficulty of removal of said shield.

17. The lighter according to claim 16, wherein said retention means comprises a hook formed at an end of the guard member and extending through an opening defined by the valve actuator, said hook engaging the valve actuator if the guard is raised.

18. The lighter according to claim 16, wherein:

said retention means comprises a portion of the shield folded inward to engage a surface of the lighter body.

19. The lighter according to claim 16, wherein the retention means comprises at least one detent formed in the shield, wherein said detent is received in a corresponding opening defined by the lighter body, said opening also for receiving an axle for supporting the spark producing element.

20. The lighter according to claim 19, wherein the retention means further comprises a plurality of tongues disposed on the shield, wherein the tongues are received in a corresponding plurality of recesses formed in the lighter body.

21. The lighter according to claim 13, wherein said guard member has a free end extending towards the lighter body with a hook formed in said free end, said hook being disposed behind a part of the lighter such that raising of the guard member causes said hook to engage said part whereby raising of the guard member is resisted.

22. A lighter comprising:

a body having a fuel reservoir and defining a central cylindrical cavity;

a striking wheel assembly rotatably mounted on the body at a top end, wherein the striking wheel assembly comprises a rotary sparker and at least one turning wheel mounted coaxially with the rotary sparker;

a flint disposed within the cylindrical cavity and in frictional contact with the rotary sparker, wherein rotation of the rotary sparker against the flint creates sparks;

a valve for releasing fuel from the fuel reservoir to outside the body of the lighter, wherein the valve has an open position and a closed position valve and wherein the valve comprises a nozzle arranged along the longitudinal axis and communicating with the fuel reservoir to selectively permit release of fuel from the reservoir;

a valve actuator pivotally attached to the body, wherein the actuator controls movement of the valve between the open position and closed position;

a shield mounted on the body, comprising an arcuate guard member disposed around a portion of the rotary sparker and elevated above the at least one turning wheel, wherein the arcuate guard is depressible to expose the at least one turning wheel; and a stop member on the lighter body, wherein the stop member is positioned at a predetermined distance away from the guard member to limit the travel of the guard member when depressed.

23. The lighter as set forth in claim 22, further comprising at least one brake member mounted on the valve actuator, wherein after the valve actuator is depressed and the valve is moved toward the open position, said at least one brake member engages the striking wheel assembly to arrest the rotation of the striking wheel assembly.

24. The lighter as set forth in claim 23, wherein said brake member comprises a gripping member adapted to engage the striking wheel assembly.

25. The lighter as set forth in claim 22, wherein the shield comprises a plurality of retention elements to resist the removal of the shield from the body of the lighter.

26. The lighter as set forth in claim 25, wherein the plurality of retention elements comprises:

a pair of tongues disposed on the shield and a pair of corresponding recesses located on the top end of the body of the lighter; and a pair of flanges on the shield, wherein the flanges engage a first edge of said top end.

27. The lighter as set forth in claim 26, wherein the plurality of retention elements further comprises:

a pair of detents disposed on the shield, wherein the detents are received by a pair of corresponding openings defined by the lighter body.

28. A lighter comprising:

a body having a top end, a fuel reservoir and defining a central cylindrical cavity;

a striking wheel assembly rotatably mounted on the body at the top end, wherein the striking wheel assembly comprises a rotary sparker and at least one turning wheel mounted co-axially with the rotary sparker;

a flint disposed within the cylindrical cavity and in frictional contact with the rotary sparker, wherein rotation of the rotary sparker against the flint creates sparks;

a valve for releasing fuel from the fuel reservoir to outside the body of the lighter, wherein the valve has an open position and a closed position and wherein the valve comprises a nozzle arranged along the longitudinal axis and communicating with the fuel reservoir to selectively permit release of fuel from the reservoir; and a valve actuator pivotally attached to the body, wherein the actuator controls movement of the valve between the open position and closed position and wherein the actuator comprises at least one brake member having a gripping member, wherein after the valve actuator is depressed and the valve is moved toward the open position, the gripping member arrests the rotation of the striking wheel assembly.

29. A lighter as set forth in claim 28, further comprising a windbreaking shield mounted on the lighter body including a safety element to limit operation of the lighter and wherein said shield includes a plurality of retention elements to resist the removal of the shield from the body of the lighter.

30. The lighter as set forth in claim 29, wherein the plurality of retention elements comprises:

a pair of tongues disposed on the shield and a pair of corresponding recesses located on the top end of the body of the lighter; and a pair of flanges on the shield, wherein the flanges engage a first edge of said top end.

31. The lighter as set forth in claim 30, wherein the plurality of retention elements further comprises:

a pair of detents disposed on the shield, wherein the detents are received by a pair of corresponding openings defined by said top end.

32. A lighter comprising:

a body having a top end, a fuel reservoir and defining a central cylindrical cavity;

a striking wheel assembly rotatably mounted on an axle received in openings in the body at the top end, wherein the striking wheel assembly comprises a rotary sparker and at least one turning wheel mounted co-axially with the rotary sparker;

a flint disposed within the cylindrical cavity and in frictional contact with the rotary sparker, wherein rotation of the rotary sparker against the flint creates sparks;

a valve for releasing fuel from the fuel reservoir to outside the body of the lighter, wherein the valve has an open position and a closed position;

a valve actuator pivotally attached to the body, wherein the actuator is capable of moving the valve between the open position and closed position and wherein the valve comprises a nozzle arranged along the longitudinal axis and communicating with the fuel reservoir to selectively permit release of fuel from the reservoir;

a shield mounted on the lighter body and surrounding said valve, said shield including a safety element to limit operation of the lighter; and retention means disposed on the shield for resisting and increasing the difficulty of removal of the shield and safety element from the body of the lighter.

33. The lighter as set forth in claim 32, wherein said retention means comprises:

a pair of tongues disposed on the shield and a pair of corresponding recesses located on the top end of the body of the lighter, said tongues being received in said recesses; and a pair of flanges on the shield, wherein the flanges engage an edge of said top end.

34. The lighter as set forth in claim 32, wherein said retention means comprises:

a pair of detents disposed on the shield, wherein the detents are received in the corresponding openings defined in the lighter body; and a pair of tongues disposed on the shield and a pair of corresponding recesses located on the top end of the body of the lighter, said tongues being received in said recesses.

35. The lighter as set forth in claim 34, wherein said guard element comprises a cover comprising an arcuate guard disposed above the rotary sparker and elevated above the at least one turning wheel, said cover and guard being formed integrally with the shield such that the arcuate guard is depressible to a position where the at least one turning wheel is manipulable.

* * * * *